US009564702B2

(12) United States Patent
Ciampolini et al.

(10) Patent No.: US 9,564,702 B2
(45) Date of Patent: Feb. 7, 2017

(54) ELECTRIC APPARATUS WITH SAFETY CONNECTOR FOR PREVENTING ELECTRIC SHOCK

(71) Applicant: MAGNETI MARELLI S.P.A., Milan (IT)

(72) Inventors: Franco Ciampolini, Milan (IT); Enrico Della Fornace, Milan (IT)

(73) Assignee: MAGNETI MARELLI S.P.A., Corbetta, Milan (IT)

( * ) Notice: Subject to any disclaimer, the term of this patent is extended or adjusted under 35 U.S.C. 154(b) by 0 days.

(21) Appl. No.: 14/951,981

(22) Filed: Nov. 25, 2015

(65) Prior Publication Data

US 2016/0156120 A1 Jun. 2, 2016

(30) Foreign Application Priority Data

Nov. 28, 2014 (IT) ..... 102014902313239

(51) Int. Cl.

| | |
|---|---|
| ***H01R 13/447*** | (2006.01) |
| ***H01H 27/08*** | (2006.01) |
| ***H01R 13/703*** | (2006.01) |
| *H01R 13/635* | (2006.01) |

(52) U.S. Cl.

CPC ..... *H01R 13/447* (2013.01); *H01H 27/08* (2013.01); *H01R 13/7031* (2013.01); *H01R 13/635* (2013.01)

(58) Field of Classification Search

CPC ..... H01R 13/447; H01R 13/7031; H01R 13/7032

See application file for complete search history.

(56) References Cited

U.S. PATENT DOCUMENTS

| | | | | |
|---|---|---|---|---|
| 4,930,918 | A | 6/1990 | Steppe et al. | |
| 2002/0114117 | A1 | 8/2002 | Milanczak | |
| 2015/0325946 | A1* | 11/2015 | Savage | H01R 13/5213 439/142 |
| 2016/0156120 | A1* | 6/2016 | Ciampolini | H01H 27/08 439/134 |

FOREIGN PATENT DOCUMENTS

| | | | |
|---|---|---|---|
| GB | 524449 | A | 8/1940 |
| GB | 974763 | A | 11/1964 |
| JP | 2014011821 | A | 1/2014 |

* cited by examiner

*Primary Examiner* — Ross Gushi

(74) *Attorney, Agent, or Firm* — Howard & Howard Attorneys PLLC

(57) ABSTRACT

An electric apparatus with safety connector for preventing electric shock, having an electric circuit comprising at least a pair of terminals electrically separated from each other, and a cover which covers the electric circuit so as to prevent access to it when it is disposed in the assembly configuration to cover the electric circuit. The cover is mechanically fixed in position by a plurality of attachment mechanisms. A safety connector associated with the cover and provided with an electric conductor element, wherein the security connector passes through the cover so as to short-circuit the terminals and a projection supports the electric conductor element and is movable from a closed configuration in which it short-circuits the terminals to an open position in which it does not short circuit the terminals. A cover element which, in closed configuration, at least partially overlaps at least one of attachment mechanisms.

27 Claims, 10 Drawing Sheets

ELECTRIC APPARATUS WITH SAFETY CONNECTOR FOR PREVENTING ELECTRIC SHOCK

CROSS-REFERENCE TO RELATED APPLICATIONS

The present application is claims priority to and all the benefits of Italian Patent Application No. 102014902313239, filed on Nov. 28, 2014, both of which are hereby expressly incorporated herein by reference in their entirety.

BACKGROUND OF THE INVENTION

1. Field of the Invention

This invention relates to an electric apparatus with safety connector for preventing electric shock, in particular in the automotive sector.

2. Description of the Related Art

As is known, the automotive sector, especially (but not exclusively) in the case of using hybrid propulsion, makes wide use of electric machines provided with associated circuits and power supply base plates.

Current regulations in many countries require the preparation of measures to avoid the risk of electric shock, in particular in case of maintenance, during which the operator may accidentally come into contact with live parts of the electric circuit.

For example, in the US there are regulations that require the use of devices or procedures that prevent the operator from coming into contact with live parts for a certain time interval, for example 5 seconds, after power is disconnected from the electric circuit to be maintained.

In practice, it is necessary to make live parts of the circuit inaccessible by the operator for a certain time interval after the electric circuit itself is opened: this time interval must be sufficient to allow the capacitors of the electric circuit to discharge so as to prevent any risk of electric shock to the maintainer.

For this purpose, solutions are known of covers that perform the function of both mechanical coverage of live parts and that of opening the electric circuit. For example, a first outer cover, when removed, opens the electric circuit and allows access to a second cover, which can have the mere function of mechanical protection. The time required to remove the second cover ensures the aforementioned discharge of the capacitors.

From a technical point of view, these known solutions are able to provide the operator the necessary electrical protection.

Nevertheless, such solutions are not without drawbacks.

In fact, the solutions known to date are relatively expensive because they require the production of multiple covers that have the function of actual mechanical protection and the function of integrating portions of the power supply circuit, to short-circuit it following assembly and open it following disassembly.

These are, therefore, ad hoc solutions that increase the costs of components that, in the automotive sector, must remain extremely low.

Therefore, there is a need to solve the drawbacks and limitations mentioned in reference to the prior art.

Therefore the need is felt to make available a safety connector for electric circuits that is not only efficient from a safety point of view but also economical from the point of view of production and assembly costs.

SUMMARY OF THE INVENTION

This need is met by an electric apparatus with safety connector for preventing electric shock, including an electric circuit having at least one pair of terminals electrically separate from each other so as to keep the electric circuit open, and a cover covering the electric circuit so as to preclude access when the cover is placed in the assembled configuration to cover the electric circuit. The cover is mechanically fixed into place using a plurality of attachment mechanisms. A safety connector is associated with the cover and equipped with an electrical conductor element, wherein the safety connector crosses the cover so as to intercept and short-circuit the terminals. The safety connector is provided with a projection which supports the electric conductor element and which is movable from a closed configuration in which it short-circuits the terminals to an open position in which it does not short circuit the terminals. The safety connector is provided with a cover element which, in the closed configuration, at least partially overlaps at least one of the attachment mechanisms of the cover, preventing the removal thereof.

BRIEF DESCRIPTION OF THE DRAWINGS

Other advantages of the invention will be readily appreciated as the same becomes better understood by reference to the following detailed description when considered in connection with the accompanying drawings, wherein.

Further characteristics and advantages of this invention will be more understandable from the following description of its preferred and non-limiting examples of embodiments, wherein.

The members, or parts of members, in common between the embodiments described below will be indicated with the same reference numbers.

DETAILED DESCRIPTION OF THE INVENTION

Figure 1:
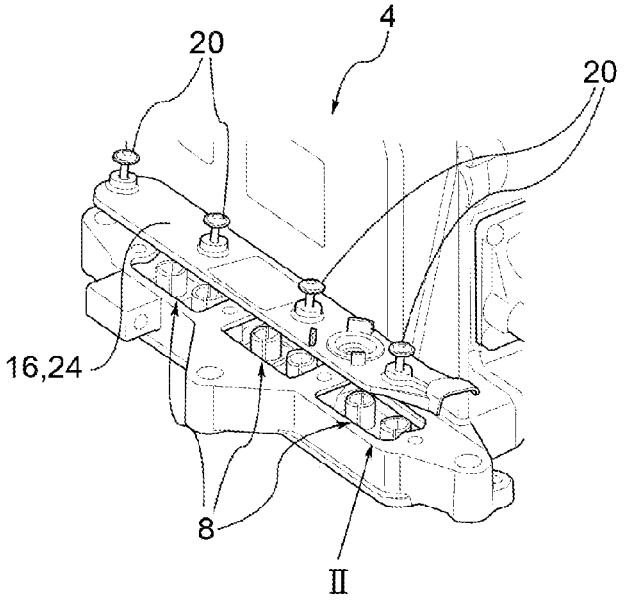
FIG. 1 is a schematic view of an electric apparatus according to an embodiment of this invention.
Figure 2:
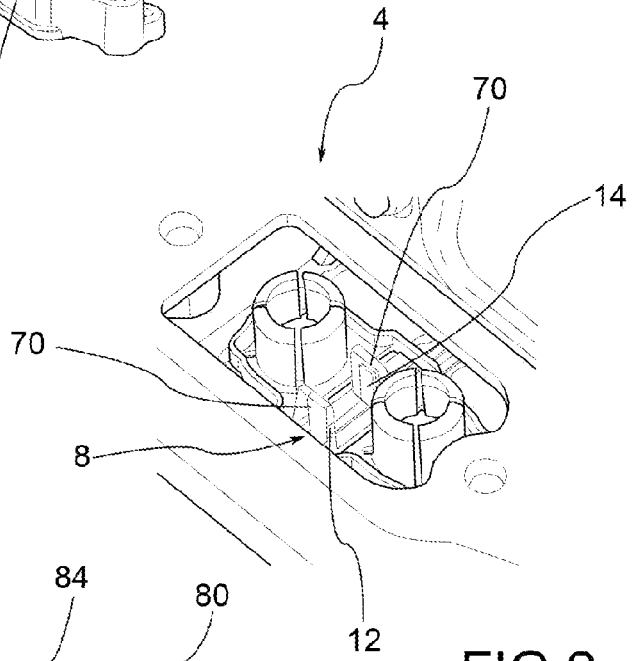
FIG. 2 is a perspective view of the enlarged detail II of FIG. 1.
Figure 3:
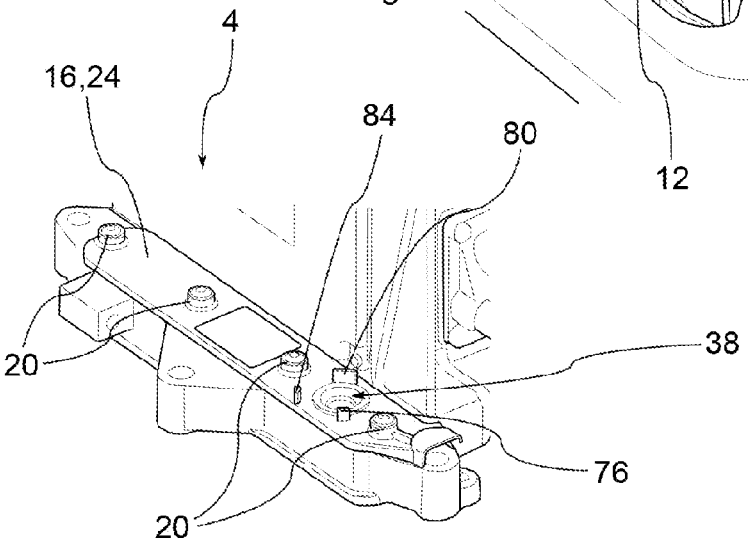
FIG. 3 is a perspective view of the apparatus of FIG. 1, in a partial assembly configuration.
Figure 4:
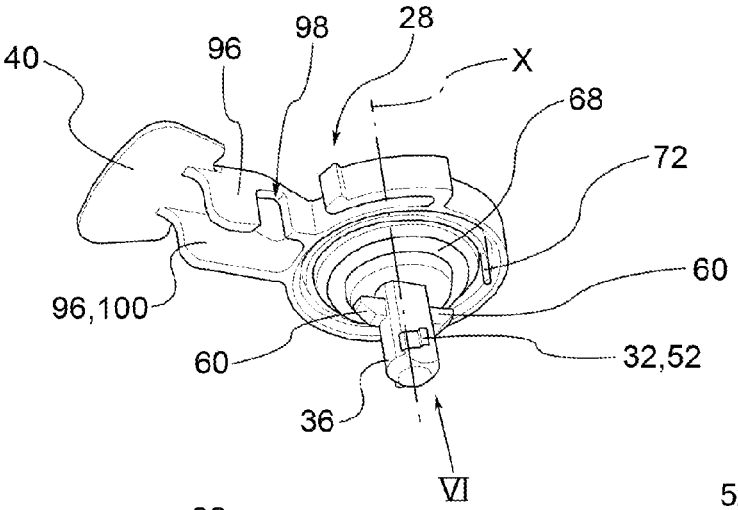
FIG. 4 is a perspective view of the safety connector associable to the electric apparatus of FIG. 1.
Figure 5:
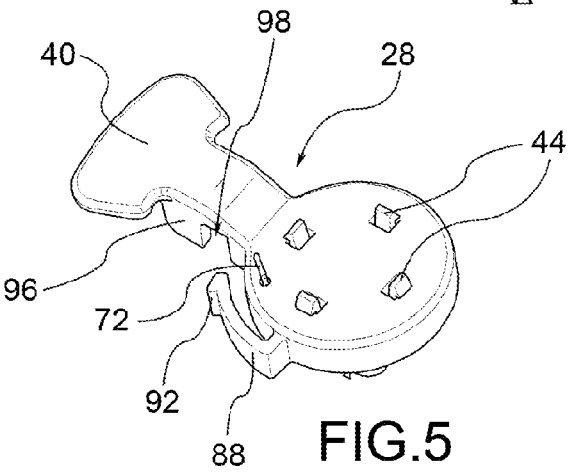
FIG. 5 is a perspective view of the safety connector associable to the electric apparatus of FIG. 1 from a different angle as illustrated in FIG. 4.
Figure 6:
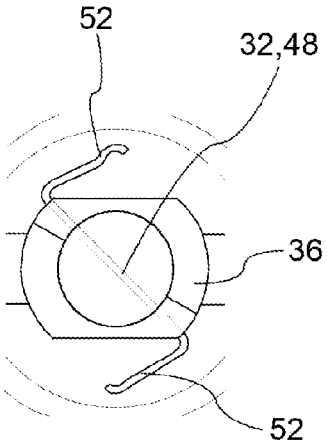
FIG. 6 is a view of a detail of the safety connector of FIG. 4, from the side of the arrow VI of FIG. 4.
Figure 7:
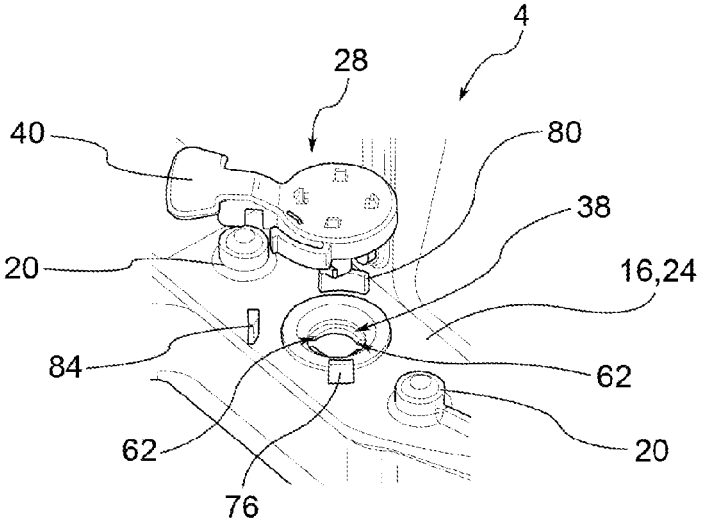
FIG. 7 is a perspective view of an assembly step of a safety connector on an electric apparatus according to this invention.
Figure 8:
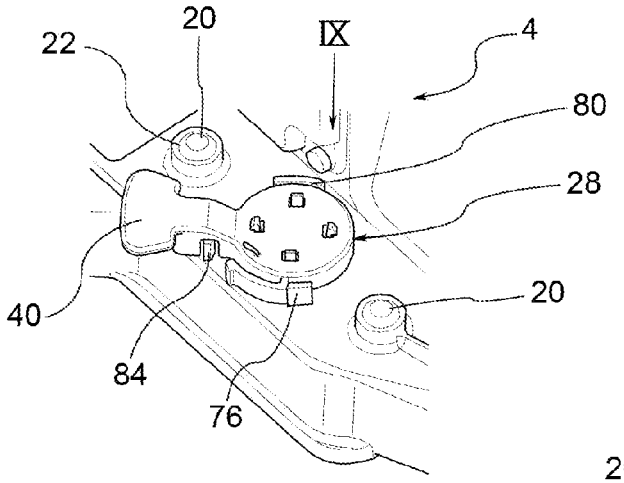
FIG. 8 is a perspective view of a successive assembly step of a safety connector on an electric apparatus according to this invention with respect to the step illustrated in FIG. 7.
Figure 9:
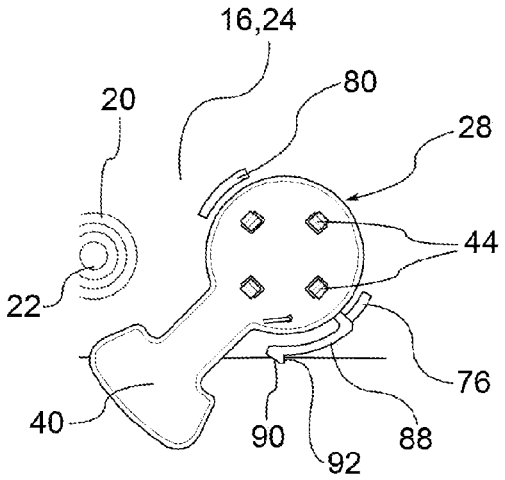
FIG. 9 is a plan view of the apparatus of FIG. 8, from the side of the arrow IX of FIG. 8.
Figure 10:
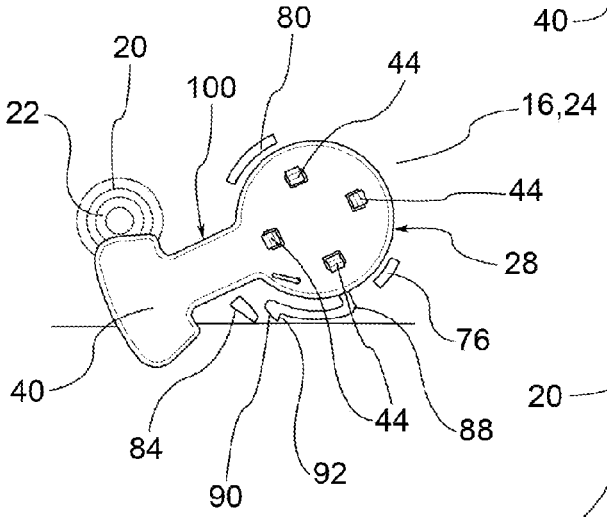
FIG. 10 is a further plan view of the electric apparatus with safety connector of FIG. 8, in a further assembly step of the safety connector.
Figure 11:
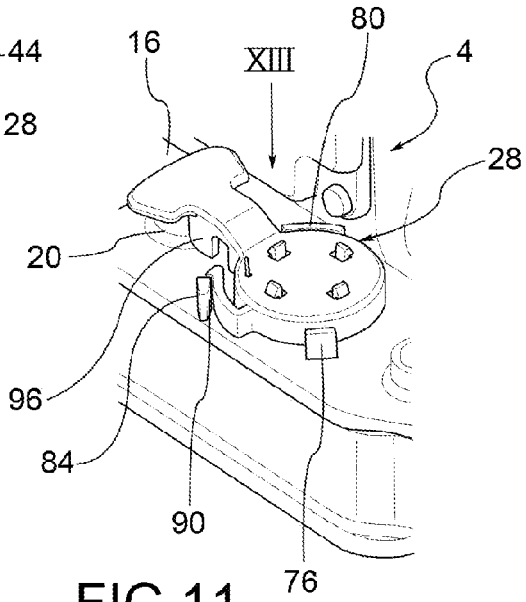
FIG. 11 is a perspective view of the electric apparatus with safety connector of FIG. 8, in closed configuration.
Figure 12:
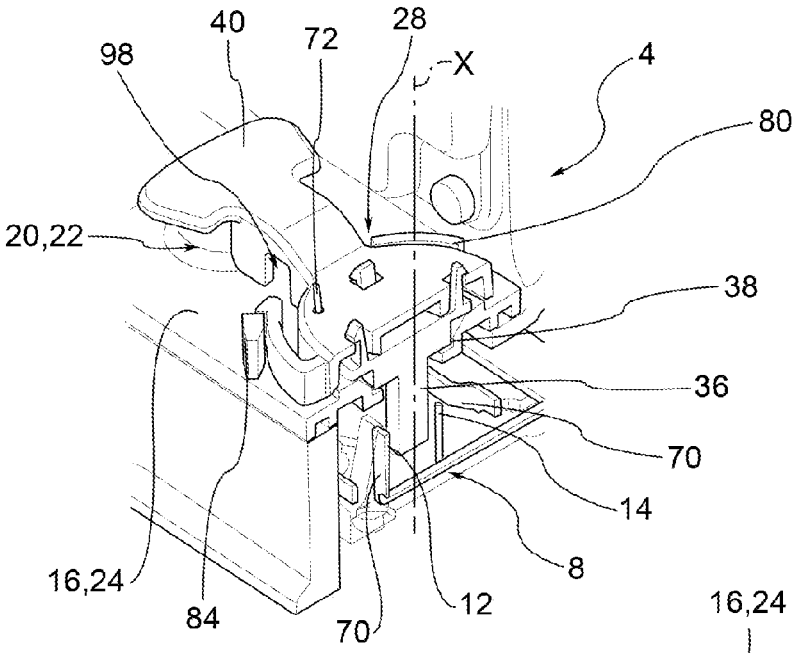
FIG. 12 is a partial sectional view of the apparatus of FIG. 11.
Figure 13:
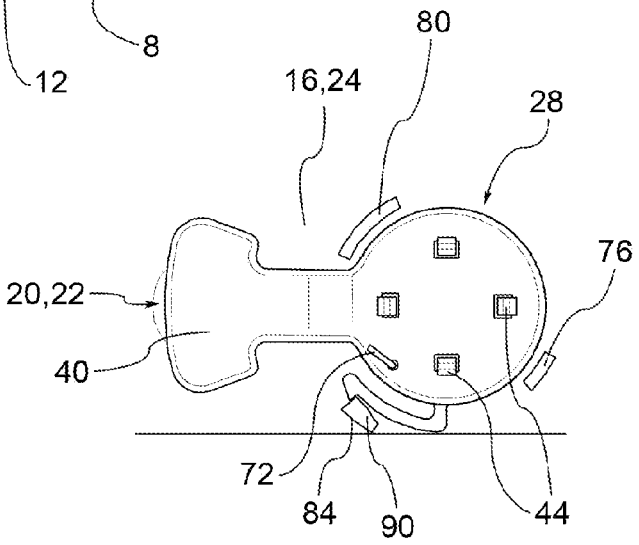
FIG. 13 is a plan view of the apparatus of FIG. 11, from the side of the arrow XIII of FIG. 11.
Figure 14:
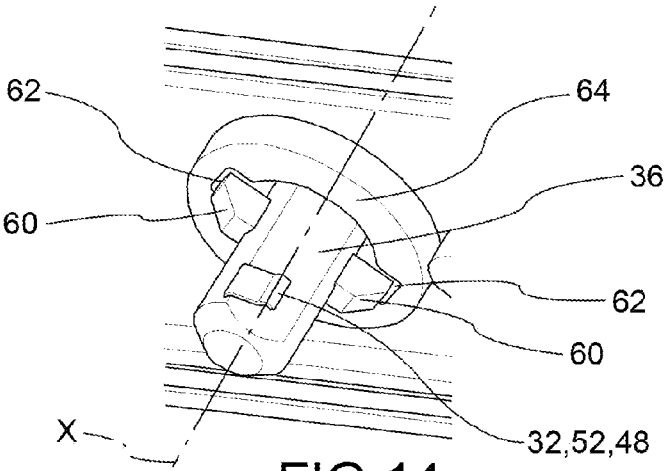
FIG. 14 is a perspective view of an internal portion of the apparatus of FIG. 8, in configuration of insertion of the safety connector in the apparatus itself.
Figure 15:
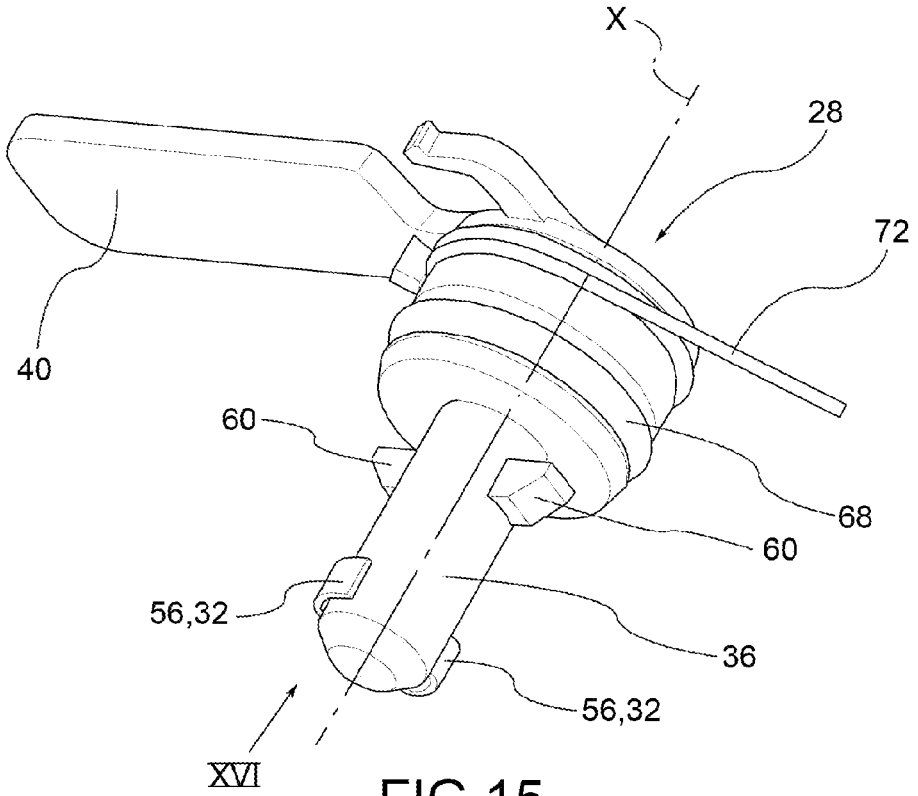
FIG. 15 is a perspective view of a safety connector according to a further embodiment of this invention.
Figure 16:
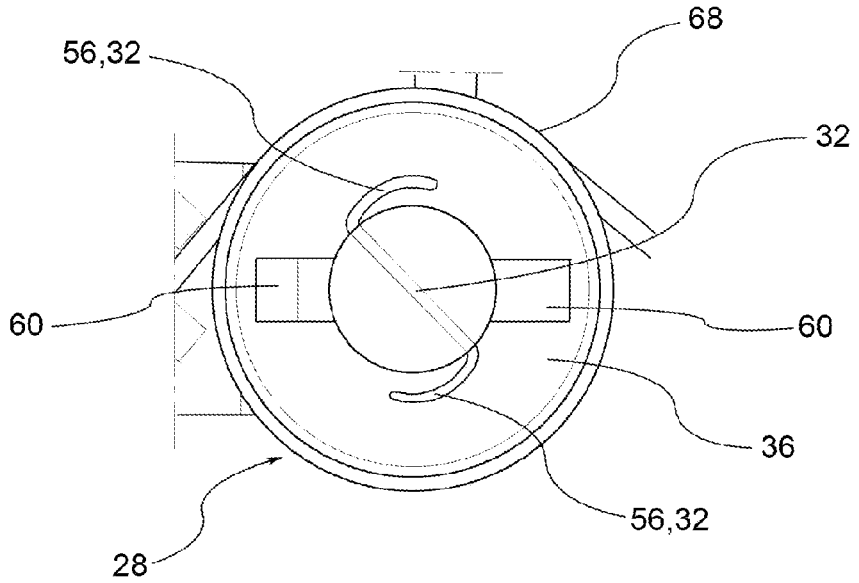
FIG. 16 is a plan view from below of the safety connector of FIG. 15, from the side of the arrow XVI of FIG. 15.
Figure 17:
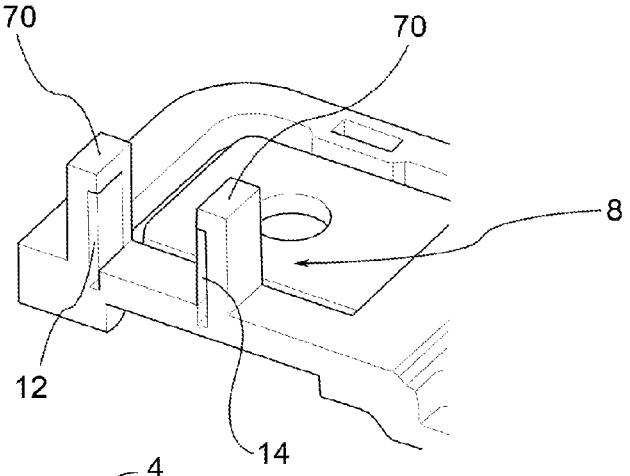
FIG. 17 is a perspective view of a detail of an electric apparatus suitable to receive a portion of a safety connector according to this invention.
Figure 18:
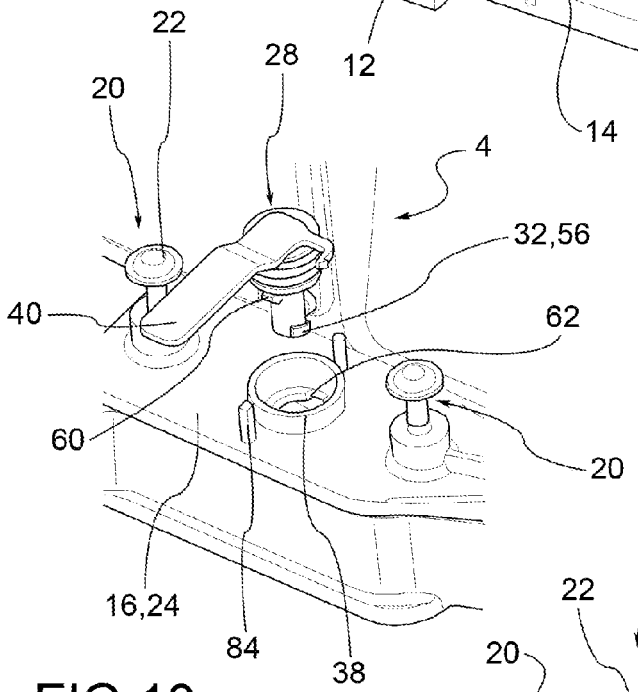
FIG. 18 is a perspective view of the safety connector of FIG. 15 in a first assembly configuration of an electric apparatus according to this invention.
Figure 19:
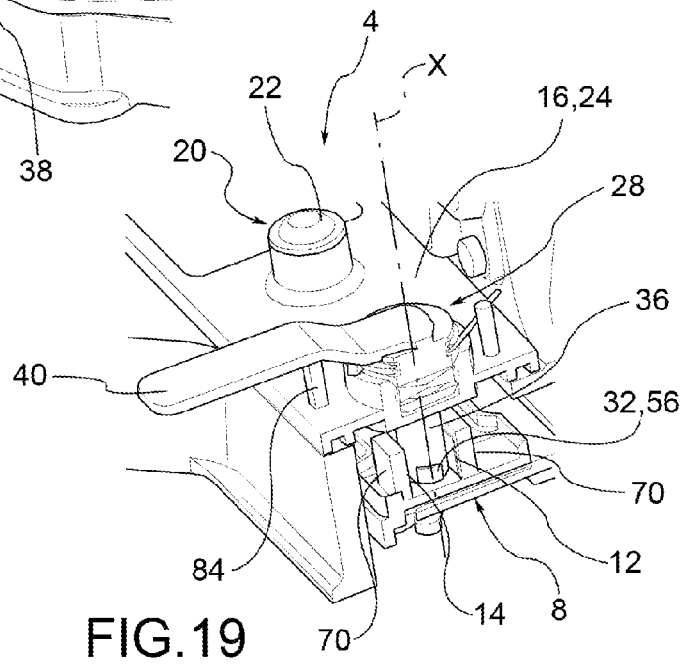
FIG. 19 is a perspective view, partially in section, of the electric apparatus of FIG. 18, in a subsequent assembly step of the safety connector.
Figure 20:
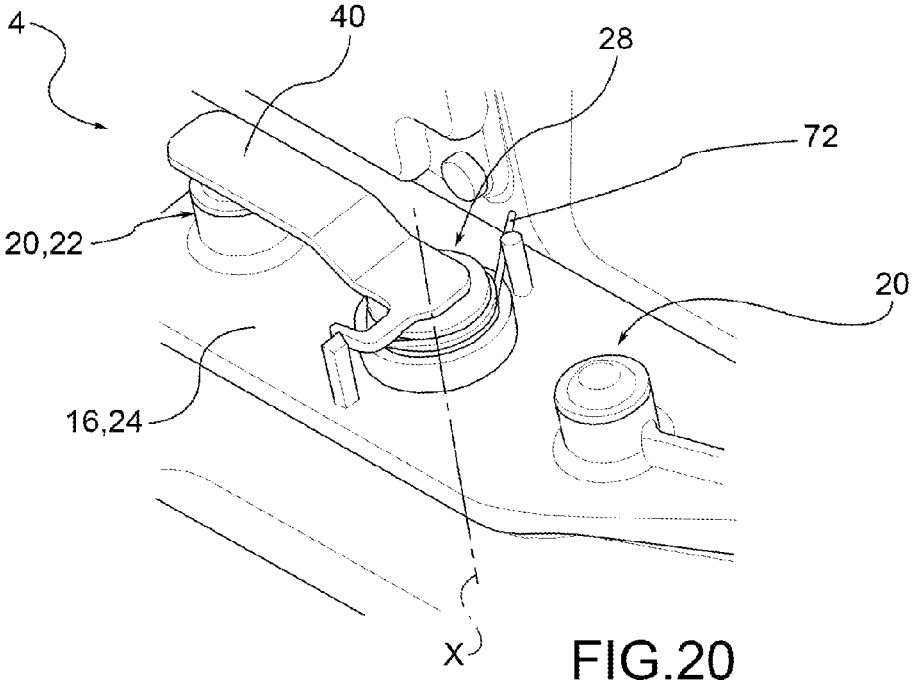
FIG. 20 is a perspective view of the safety connector of FIG. 15 in assembly and closure configuration on an electric apparatus according to an embodiment of this invention.
Figure 21:
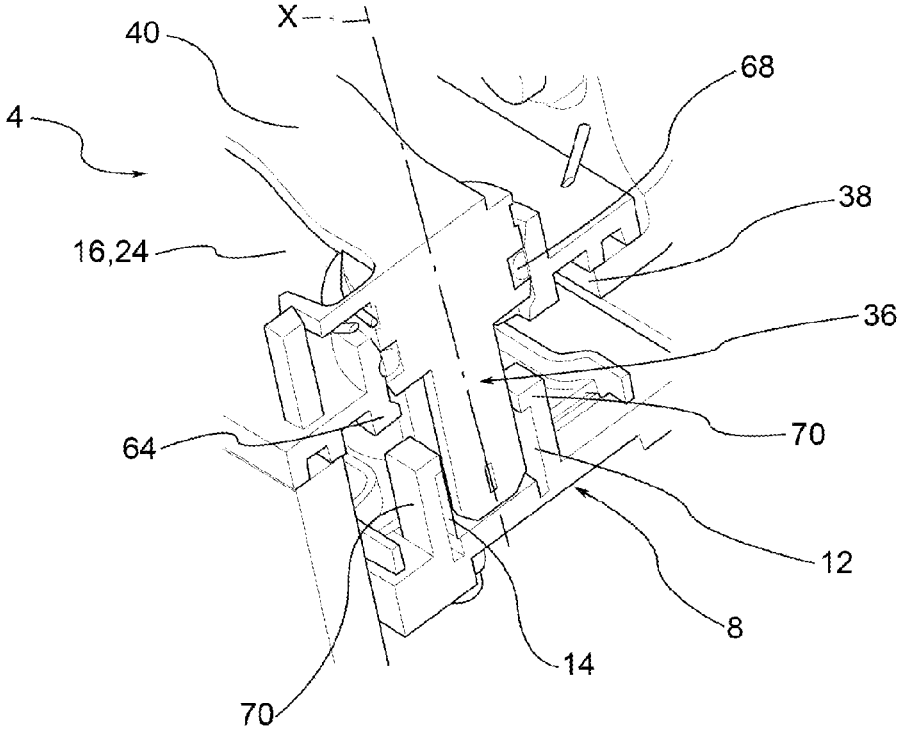
FIG. 21 is a partial sectional view of the apparatus of FIG. 20, in an assembly and closure configuration.
Figure 22:
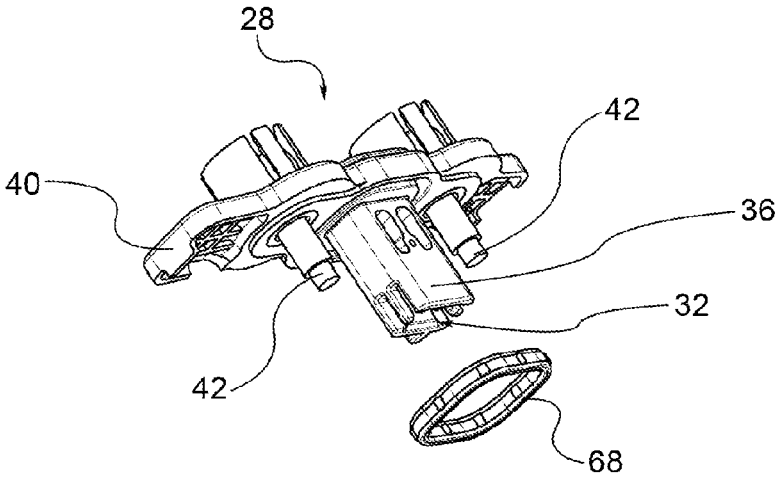
FIG. 22 is a perspective view of a safety connector according to a further embodiment of the present invention.
Figure 23:
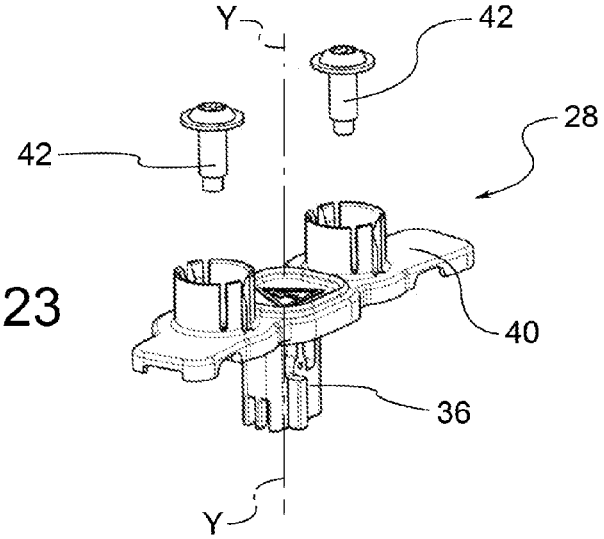
FIG. 23 is a perspective view of a safety connector according to a further embodiment of the present invention.
Figure 24:
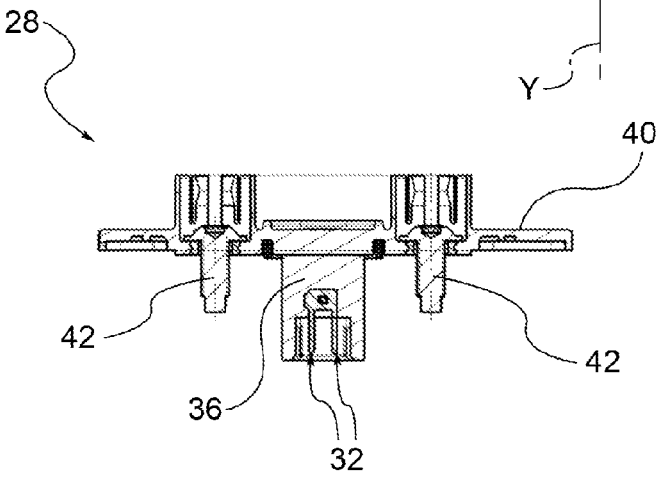
FIG. 24 is a cross sectional view of the safety connector of FIGS. 22-23.
Figure 25:
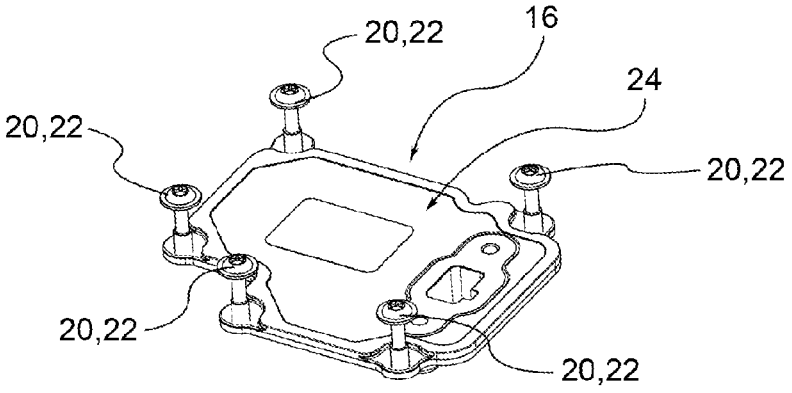
FIG. 25 is a perspective view of a cover or lid adapted to receive the safety connector according to the embodiment of FIGS. 22-24.
Figure 26:
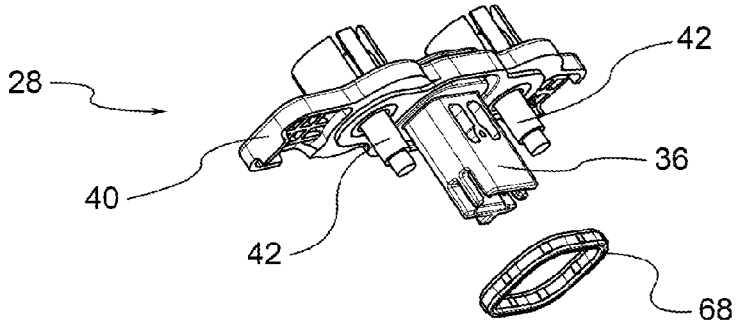
FIG. 26 is a perspective view of a safety connector according to a further embodiment of the present invention.
Figure 27:
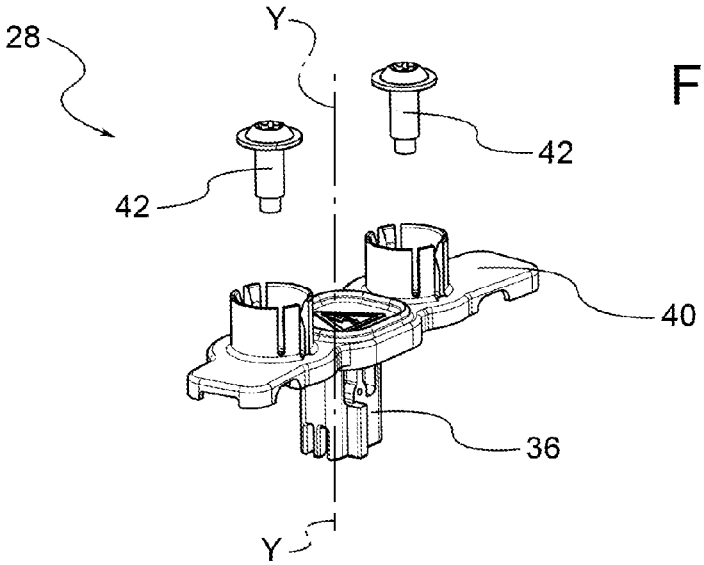
FIG. 27 is a perspective view of a safety connector according to a further embodiment of the present invention.
Figure 28:
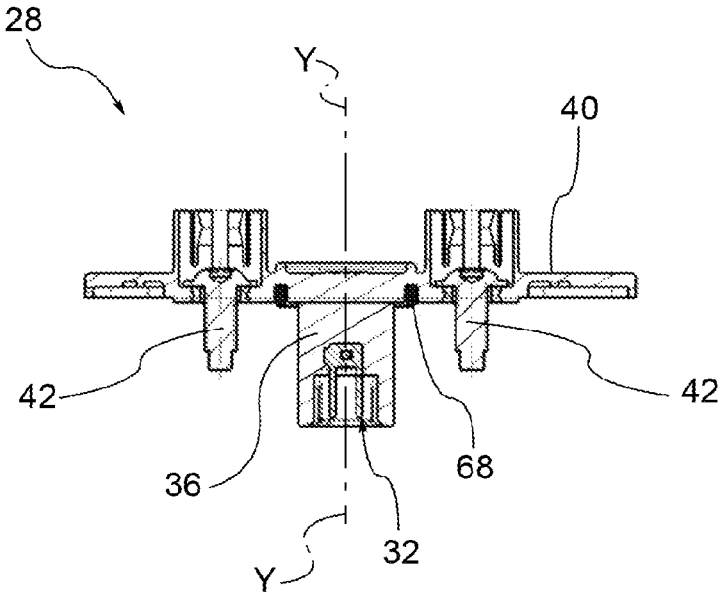
FIG. 28 is a cross sectional view of the safety connector of FIGS. 26-27.
Figure 29:
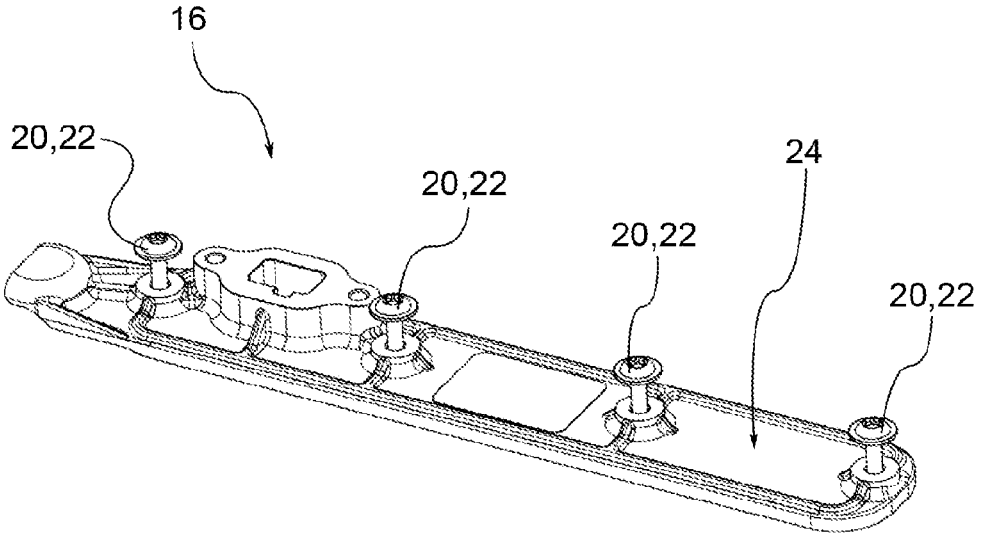
FIG. 29 is a perspective view of a cover or lid adapted to receive the safety connector according to the embodiment of FIGS. 26-28.

With reference to the above figures, reference number 4 globally indicates an overall schematic view of an electric apparatus according to this invention.

For the purposes of the scope of protection of this invention, the specific type of electronic apparatus, understood to be, preferably but not exclusively, an electric apparatus for automotive applications, is not relevant.

The electric apparatus 4 includes an electric circuit 8 having at least one pair of terminals 12, 14 electrically separate from each other so as to keep the electric circuit open. In other words, the terminals 12, 14 are normally facing and electrically disconnected from each other, so as to have an open electric circuit.

The electric apparatus 4 also includes a cover 16 that covers said electric circuit 8 so as to prevent access when the cover 16 is disposed in assembly configuration to cover the electric circuit 8. In other words, the cover 16 has the function of physically preventing access to parts of the live electric circuit 8 so as to prevent the risk of an operator receiving an electric shock.

The cover 16 is mechanically fixed in place by a plurality of attachment mechanism 20. The attachment mechanism 20 may comprise screws and bolts having heads 22 that rest on an outer wall 24 of the cover, opposite to the electric circuit 8.

Advantageously, the electric apparatus 4 includes a safety connector 28 associated to the cover 16 and provided with an electric conductor element 32; the safety connector 28 passes through the cover 16 so as to intercept and short-circuit the terminals 12, 14. The safety connector 28 is provided with a projection 36 that supports the electric conductor element 32 and is movable from a closed configuration, in which it short-circuits the terminals 12, 14 to an open position in which it does not short-circuit the terminals 12, 14 (thus leaving the circuit electrically open).

With the word 'movable' it is intended that the safety connector 28 can be at least partially removed from the cover 16 so as not to short-circuit the terminals 12,14, in the open position or configuration. For example, the projection 36 passes through an engagement hole 38 of the cover 16 so as to intercept the terminals 12, 14 of the electrical circuit 8.

Advantageously, the safety connector 28 is provided with a cover element 40 that, in said closed configuration, at least partially overlaps at least one of said attachment mechanisms 20 of the cover 16, preventing its removal. In other words, in the closed configuration the cover element 40 is superimposed at least partially on at least one of the attachment mechanisms 20, for example overlying a head 22 of an attachment mechanism 20 so as to prevent the operator from reaching the head with a tool such as a screwdriver or a spanner, and/or to prevent, in any case, the operator from removing the attachment mechanism 20 and thus the cover 16 itself. In fact, if it is not possible to remove all the attachment mechanisms 20 of the cover 16, it will not even be possible to remove the cover 16 and, therefore, physical access the electric circuit 8, as long as the safety connector 28 and the corresponding cover element 40 are not moved from the closed configuration.

In the description and accompanying figures, a single attachment mechanism 20 is always shown intercepted and/or surmounted by said cover element 40; for the purposes of this invention, it is also possible to provide that two or more attachment mechanisms 20 can be surmounted, intercepted and therefore in position by the cover element 40 as long as the safety connector 28 is disposed in the closed position. In this way, for example, the safety of the device is increased since it extends the time the operator needs to disassemble all the attachment mechanisms after having rotated/moved the safety connector 28 and thus after opening the electric circuit. In other words it further increases the discharge time of the capacitors of the electric circuit 8, before the operator can come in contact with it.

Therefore, the cover element 40 is superimposed on the cover 16, on the side opposite the electric circuit 8, i.e., on the side of said outer wall 24 of the cover itself. In one embodiment, the cover element 40 is configured as a gripping element so as to allow both the gripping/movement of the safety connector 28 and the blocking of the removal at least one of the attachment mechanisms 20 of the cover 16.

According to a possible embodiment of the present invention, the safety connector 28 is axially inserted, through the cover 16 by a shape coupling; according to an embodiment said shape coupling is a prismatic coupling which enables an axial insertion of the safety connector 28 within the cover 16 parallel to an axial direction of insertion Y-Y. In this embodiment, the safety connector 28 can be at least partially removed from the cover 16 so as not to short-circuit the terminals 12, 14, in the open position or configuration, by detaching at least partially the safety connector from the cover 16. In this way, in fact, the electric conductor element 32 is physically detached from the terminals 12, 14. For example, the safety connector 28 is fixed to the relative lid 16 by screws 42; preferably such screws 42 are captive screws.

According to a possible embodiment of the present invention, the safety connector 28 is rotatably attached to the cover 16 with respect to an axis of rotation X-X, so as to rotate from the open position, in which the projection 36 is offset with respect to the terminals 12,14 so as not to short-circuit them, and the cover element 40 is offset with respect to at least one of the attachment mechanisms 20 of the lid 16, to the closed position in which the projection 36 short-circuits the terminals 12,14 and the cover element 40 overlaps at least one of the attachment mechanisms 20.

In this embodiment, the safety connector 28 can be rotated within the cover 16, without being removed from the cover so as not to short-circuit the terminals 12, 14, in the open position or configuration. For example, the projection 36 and the cover element 40 are joined together by connection mechanism 44, so as to be mutually detachable. For example, the connection mechanism may comprise teeth, fins or tabs that create a mutual shape connection, preferably of the snap type.

As seen, the projection 36 has the function of short-circuiting the terminals 12, 14. For example, the projection 36 comprises a spring 48 in conductive material fitted with a pair of projecting flexible tabs 52 that, in the closed configuration, short-circuit said terminals 12, 14 and that, in the open configuration, are offset with respect to the terminals 12,14 so as to leave the electric circuit 8 open.

According to a further embodiment, the projection 36 is fitted with a pair of conductor plates 56 diametrically opposite and electrically connected to each other, so that, in the closed configuration, the conductor plates 56 are facing and electrically connected to the terminals 12, 14 and, in the open configuration, said conductor plates 56 are offset with respect to the terminals 12, 14.

According to an embodiment, the projection 36 is provided with at least one retention tooth 60, counter-shaped to a corresponding seat 62 on the cover 16 made at the engagement hole 38, in which the retention tooth 60 allows the insertion of the projection 36 through the seat 62 when the safety connector 28 is in the open position, and abuts against a stop wall 64 of the cover 16 so as to prevent the removal of the safety connector 28 from the seat 62 in the closed configuration.

Preferably, the projection 36 is provided with two retention teeth 60 counter-shaped to respective seats 62 on the cover 16 formed in correspondence of the engagement hole 38. The retention teeth 60 can be different from each other, each associated to a corresponding counter-shaped seat 62, so as to ensure a proper assembly of the safety connector 28 on the cover 16. For example, the stop wall 64 is facing the electric circuit 8 and opposite to the outer wall 24 of the cover 16.

According to an embodiment, between the safety connector 28 and an outer wall 24 of the cover 16, opposite the electric circuit 8, a gasket 68 associated with the safety connector 28 is placed next to said engagement hole 38, so as to seal closed the connection between the safety connector 28 and the cover 16.

Preferably, the gasket 68 is placed and/or shaped so as to be influenced in compression when the retention tooth 60 crosses the seat 62 and stops in abutment against the stop wall 64 of the cover 16.

According to an embodiment, the portion of cover 16 that delimits the engagement hole 38 has a truncated cone shape that narrows towards the electric circuit 8. This truncated cone configuration ensures a uniform compression of the gasket 68 and improves the overall hermetic seal of the coupling of the safety connector 28.

The terminals 12,14 of the electric circuit 8 are, for example, supported by base plates 70 at least partially counter-shaped to the projection 36 of the safety connector 28, so as to support the mechanical contact between the terminals 12,14 and the projection 36 in the closed configuration of the safety connector 28.

According to a possible embodiment, the safety connector 28 is fitted with a return spring 72 that influences the safety connector to move into the open configuration. In other words, if the operator does not hook the safety connector 28 well with respect to the cover 16, the return spring elastically returns the safety connector to the open position of the electric circuit 8.

According to an embodiment, the cover 16 is provided with a limit switch in opening 76, which projects from the cover 16 from the opposite side to the electric circuit 8 in order to achieve the maximum displacement when opening the safety connector 28 in order to allow free access and the removal of the attachment mechanism 20 influenced by the cover element 40 in the closed configuration.

Preferably, the cover 16 is provided with a limit switch in closing 80, which projects from the cover 16 from the opposite side to the electric circuit 8 in order to achieve the maximum displacement when closing the safety connector 28 in order to prevent free access and the removal of the attachment mechanism 20 influenced by the cover element 40 in the closed configuration.

Preferably, the cover 16 is fitted with a locking element 84, which projects from the cover 16 on the opposite side to the electric circuit 8 in order to allow the coupling of a corresponding tab 88 of the cover element 40, when the safety connector 28 is moved into the closed configuration. For example, the tab 88 is elastically flexible so as to snap engage the locking element 84 when the safety connector 28 is moved into the closed configuration.

In one embodiment, the locking element 84 and/or the tab 88 includes chamfers or guides 90 which favour their reciprocal engagement in the closing movement/rotation of the safety connector 28. This mutual coupling is also favoured by the elastic deformation of the tab 88 under the thrust received from the impact against the locking element 84. Also, the tab 88 may include an undercut 92 which abuts against the locking element 84 in order to prevent accidental opening of the safety connector 28. As described above, the attachment mechanism 20 may be a screw or bolt 22 whose head is surmounted by the cover element 40 in the closed configuration of the safety connector 28.

According to an embodiment, the cover element 40 is configured with a reinforcement wall 96, substantially perpendicular to the cover 16 in order to create a reinforcement for the cover element 40 and an end stroke for the movement of the safety connector 28. For example, the reinforcement wall 96 may include a recess 98 suitable to allow the bypassing of the limit switch in opening 76, associated with the cover 16 to set the maximum displacement in opening of the safety connector 28.

According to an embodiment, the reinforcement wall 96 comprises an abutment 100 suitable to interface with the limit switch in closing 80, associated with the cover 16 to set the maximum displacement in closing of the safety connector 28.

According to a possible embodiment of this invention, the attachment mechanism 20 intercepted by the cover element 40 comprise a slider (not shown) that, following the removal of said attachment mechanism 20, projects from an outer wall 24 of the cover 16 in order to interfere with the cover element 40, preventing the assembly of the safety connector 28 in case of non-installation of the attachment mechanism 20. In this way, it is avoided that the operator may forget to reassemble the apparatus without screwing the attachment mechanisms 20 normally intercepted by the cover element. In fact, if this is the case, the operator himself would be able to subsequently disassemble the cover, remove it without have to wait for the removal of said attachment mechanism 20 and there would not be the time required for the capacitors to discharge.

According to an embodiment, the attachment mechanism 20 are captive screws, i.e., special screws that require the use of appropriate tools in order to be removed from the relative cover 16. Such captive screws are, in fact, shaped so that they cannot be easily separated from the plate with the hole in which they are inserted; this effect, in a known manner, can be obtained by a suitable shaping of the stem and/or of the head in order to obtain suitable undercuts that constrain the screw preventing it from being easily removed. In this way, it is avoided that the operator can lose said screws in the steps of disassembly and reassembly of the cover 16.

We will now describe the functioning, as well as the technique of maintaining, the electric apparatus provided with safety device according to this invention. In particular, in the closed configuration of the cover 16 and the safety connector 28, the electric circuit is protected from the outside and electrically short-circuited by the electric conductor element 32 that interfaces with the terminals 12, 14. For example, as seen, the elastic tabs 52 or conductor plates 56 bring each other into contact with a respective terminal 12, 14 so to provide the electrical connection between the terminals themselves. In closed configuration, the mechanical locking of the safety connector 28 on the cover 16 is for example obtained by a coupling between the locking element 84 and/or the tab 88. The possible presence of the undercut 92 which abuts against the locking element 84, prevents accidental opening of the safety connector 28. This mechanical connection remains fixed even in case of shock, vibration and the like.

In addition, the gasket 68 ensures the hermetic seal of the safety connector 28 on the cover 16 and hence the hermetic seal of the electric circuit 8.

The possible extraction of the safety device 28 from the cover is prevented by the abutment between at least one retention tooth 60 and the stop wall 64 of the cover 16. In fact, until the safety device 28 is in the closed position, the retention 60 is offset with respect to the respective seat 62 on the engagement hole 38 and thus cannot be extracted.

If it is necessary to maintain the electric circuit 8, it will be necessary to access the electric circuit 8 safely. In this regard, it is necessary to remove all the attachment mechanisms 20. It is clear that, in order to remove at least one of the attachment mechanisms 20 of the cover, one is forced to move/rotate the safety device 28 in the open position. Doing this requires first unhooking the coupling between the locking element 84 and/or the tab 88. So, one moves/rotates the safety device 28 in the open position; in this way, the electric circuit is opened when the elastic tabs 52 and/or the conductor plates 56 are offset with respect to the terminals 12, 14.

Thus, the discharge of the capacitors of the electric circuit 8 begins. In the meantime, the operator can extract the safety connector 28 from the cover 16, after having first aligned the retention teeth 60 with the relative seats 62. Thus, the operator also has free access to the retention mechanism 20 previously intercepted/surmounted by the cover element 40. The removal of the last attachment mechanism 20 also allows the removal of the cover 16 and thus access to the electric circuit 8, which will be completely or substantially discharged of electricity and can be handled safely by the operator.

As can be appreciated from the description, the electric apparatus with safety connector according to the invention allows overcoming the drawbacks presented in the prior art. In fact, the safety connector of this invention allows ensuring operator safety while maintaining the production and assembly costs of the component low. In fact, the functions of the components of the device are separated and simplified.

The cover has the sole function of preventing access to mechanical parts normally live: so, the cover physically closes access to live parts without requiring any parts that can interact directly with live portions. In other words, the cover does not comprise live portions that constitute parts of the electric circuit. This also constitutes a further safety device for the operator since the cover itself is never live (so there is no risk of eddy currents that can pass through the cover and be discharged on the operator. The connector, in turn, has the sole function of opening/closing the electric circuit and has no mechanical locking function of the cover.

In addition, the connector performs the protection function because, when it is in the closed position, it intercepts at least one mechanical attachment mechanism of the cover, making it impossible to removal. In this way, one obtains safety for the operator while keeping the costs of the device low. Furthermore, the safety connector according to the invention is simple and economical to produce.

A person skilled in the art, in order to satisfy contingent and specific needs, may make numerous modifications and variations to the electric apparatuses and safety devices described above, all however contained within the scope of the invention as defined by the following claims.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. Electric apparatus with safety connector for preventing electric shock, comprising:

an electric circuit comprising at least one pair of terminals electrically separate from each other so as to keep the electric circuit open, a cover covering said electric circuit so as to preclude access when the cover is placed in the assembled configuration to cover the electric circuit, the cover being mechanically fixed into place using a plurality of attachment mechanisms, a safety connector associated with the cover and equipped with an electrical conductor element, wherein the safety connector crosses the cover so as to intercept and short-circuit the terminals, wherein the safety connector is provided with a projection which supports the electric conductor element and which is movable from a closed configuration in which it short-circuits the terminals to an open position in which it does not short circuit the terminals, the safety connector is provided with a cover element which, in said closed configuration, at least partially overlaps at least one of said attachment mechanisms of the cover, preventing the removal thereof.

2. Electrical apparatus according to claim 1, wherein said cover element is configured as a gripping element so as to allow both the gripping/movement of the safety connector and the blocking of the removal at least one of the attachment mechanisms of the cover.

3. Electrical apparatus according to claim 1, wherein the safety connector is axially inserted, through the cover by a shape coupling parallel to an axial direction of insertion.

4. Electrical apparatus according to claim 3, wherein said shape coupling is a prismatic coupling.

5. Electrical apparatus according to claim 1, wherein the safety connector is rotatably attached to the cover with respect to an axis of rotation, so as to rotate from the open position in which the projection is offset with respect to the terminals so as not to short-circuit them, and the cover element is offset with respect to at least one of the attachment mechanisms of the lid, to the closed position wherein the projection short-circuits the terminals and the cover element overlaps at least one of the attachment mechanisms.

6. Electric apparatus according to claim 1, wherein the projection and the cover element are joined together by connection mechanism, so as to be mutually detachable.

7. Electric apparatus according to claim 1, wherein the projection comprises a spring in electrically conductive material fitted with a pair of projecting flexible tabs which in the closed configuration short-circuit said terminals and which in the open configuration, are offset with respect to the terminals.

8. Electric apparatus according to claim 1, wherein the projection is fitted with a pair of conductor plates diametrically opposite and electrically connected to each other, so that, in the closed configuration, the conductor plates are facing and electrically connected to the terminals and in the open configuration, said conductor plates are offset with respect to the terminals.

9. Electric apparatus according to claim 1, wherein the cover element is superposed on the cover, on the opposite side to the electric circuit and the projection passes through an engagement hole of the cover so as to intercept the terminals of the electric circuit.

10. Electrical apparatus according to claim 9, wherein the projection is provided with at least one retention tooth, counter-shaped to a corresponding seat on the cover made at the engagement hole, wherein the retention tooth allows the insertion of the projection through the seat when the safety connector is in the open position, and abuts against a stop wall of the cover so as to prevent the removal of the safety connector from the seat in the closed configuration.

11. Electric apparatus according to claim 10, wherein between the safety connector and an outer wall of the cover opposite the electric circuit, a gasket associated with the safety connector is placed next to said engagement hole, so as to seal closed the connection between the safety connector and the cover.

12. Electric apparatus according to claim 11, wherein the gasket is placed and/or shaped so as to be influenced in compression when the retention tooth crosses the seat and stops in abutment against the stop wall of the cover.

13. Electric apparatus according to claim 9, wherein the portion of the cover which delimits the engagement hole has a truncated cone shape that narrows towards the electric circuit.

14. Electric apparatus according to claim 1, wherein the terminals of the electric circuit are supported by base plates at least partially counter-shaped to the projection of the safety connector, so as to support the mechanical contact between the terminals and the projection in the closed configuration of the safety connector.

15. Electric apparatus according to claim 1, wherein the safety connector is fitted with a return spring which influences the safety connector to move into the open configuration.

16. Electric apparatus according to claim 1, wherein the cover is provided with a limit switch in opening, which projects from the cover from the opposite side to the electric circuit in order to achieve the maximum displacement when opening the safety connector in order to allow free access and the removal of at least one the attachment mechanisms influenced by the cover element in the closed configuration.

17. Electric apparatus according to claim 1, wherein the cover is provided with a limit switch in closing, which projects from the cover from the opposite side to the electric circuit in order to achieve the maximum displacement when closing the safety connector in order to prevent free access and the removal of the attachment mechanisms influenced by the cover element in the closed configuration.

18. Electric apparatus according to claim 1, wherein the cover is fitted with a locking element, which projects from the cover on the opposite side to the electric circuit in order to allow the coupling of a corresponding tab of the cover element, when the safety connector is moved into the closed configuration.

19. Electric apparatus according to claim 18, wherein the tab is elastically flexible so as to snap engage the locking element when the safety connector is moved into the closed configuration.

20. Electric apparatus according to claim 18, wherein the locking element and/or the tab comprises chamfers or guides which favour their reciprocal engagement in the movement/rotation of the safety connector.

21. Electric apparatus according to claim 18, wherein the tab comprises an undercut which abuts against the locking element in order to prevent accidental opening of the safety connector.

22. Electric apparatus according to claim 1, wherein the attachment mechanisms are a screw or bolt, the head of which is surmounted by the cover element in the closed configuration.

23. Electric apparatus according to claim 1, wherein the cover element is configured with a reinforcement wall, substantially perpendicular to the cover in order to create a reinforcement for the cover element and an end stroke for the movement of the safety connector.

24. Electric apparatus according to claim 23, wherein said reinforcement wall comprises a recess suitable to allow the bypassing of a limit switch in opening, associated with the cover to set the maximum displacement in opening of the safety connector.

25. Electric apparatus according to claim 21, wherein said reinforcement wall comprises an abutment suitable to interface with a limit switch in closing, associated with the cover to set the maximum displacement in closing of the safety connector.

26. Electric apparatus according to claim 1, wherein the attachment mechanisms intercepted by the cover element comprise a slider which, following the removal of said attachment mechanisms, projects from an outer wall of the cover in order to interfere with the cover element, preventing the assembly of the safety connector in case of non-installation of the attachment mechanisms.

27. Electric apparatus according to claim 1, wherein the attachment mechanisms are captive screws, i.e. special screws that require the use of appropriate tools in order to be removed from the relative cover.

* * * * *